United States Patent [19]

Ikeda et al.

[11] Patent Number: 4,964,872

[45] Date of Patent: Oct. 23, 1990

[54] PROCESS FOR RESIN FINISHING FABRICS

[75] Inventors: Takashi Ikeda, Yao; Hisao Takagishi, Soraku; Terumasa Saka, Sakai, all of Japan

[73] Assignee: Sumitomo Chemical Company, Limited, Osaka, Japan

[21] Appl. No.: 469,677

[22] Filed: Jan. 25, 1990

Related U.S. Application Data

[63] Continuation of Ser. No. 281,047, Dec. 8, 1988, abandoned.

[30] Foreign Application Priority Data

Dec. 11, 1987 [JP] Japan ..... 62-314798

[51] Int. Cl.[5] ..... D06M 9/00; D06M 1/00; D06P 3/82; D06P 5/02

[52] U.S. Cl. ..... 8/115.66; 8/115.57; 8/181; 8/189

[58] Field of Search ..... 8/181, 189, 115.66, 8/115.57, 116.1

[56] References Cited

FOREIGN PATENT DOCUMENTS

| | | |
|---|---|---|
| 50-94297 | 7/1975 | Japan . |
| 58-87367 | 5/1983 | Japan . |
| 58-87368 | 5/1983 | Japan . |
| 59-116476 | 7/1984 | Japan . |

*Primary Examiner*—Paul Lieberman
*Assistant Examiner*—John F. McNally
*Attorney, Agent, or Firm*—Birch, Stewart, Kolasch & Birch

[57] ABSTRACT

Fabrics, particularly cellulosic fabrics is resin finished with a combination of 1,3-dimethylglyoxalmonourein and trimethylolpropane, whereby the fabrics has improved crease resistance and shrink-proofing and generates no unpleasant odor.

13 Claims, No Drawings

PROCESS FOR RESIN FINISHING FABRICS

This application is a continuation, of application Ser. No. 07/281,047 filed on Dec. 8, 1988, now abandoned.

BACKGROUND OF THE INVENTION

1. Field of the Invention

The present invention relates to a process for resin finishing fabrics or blended yarn fabrics comprising cellulosic fibers with 1,3-dimethylglyoxalmonourein.

2. Description of the Related Art

Hitherto, as finishing agents for imparting crease resistance and shrink-proofing to fabrics comprising cellulosic fibers, formaldehyde resins such as reaction products of formaldehyde with urea, melamine, ethyleneurea, propyleneurea, glyoxalmonourein or alkylcarbamate have been used.

Although these agents can impart excellent crease resistance and shrink-proofing to the fabrics, their use for clothes is restricted because the fabrics finished with them tend to readily release free formaldehyde which is harmful to skins.

Thus, a finishing agent which contains no formaldehyde is highly appreciated. Recently, 1,3-dimethylglyoxalmonourein is most widely used as the finishing agent of the fabrics. However, finishing of the fabrics, which are dyed with fluorescence dyestuffs, with 1,3-dimethylglyoxalmonourein results in deterioration of whiteness of the finished fabrics and generation of unfavorable amine odor.

It has been proposed to reduce the unfavorable amine odor by the use of an organic acid such as oxalic acid, maleic acid, tartaric acid and the like together with the finishing agents. However this measure causes further deterioration of whiteness of the fabrics because the fluorescence dyestuff is attacked by the organic acid and also stiffening of the fabrics due to the acid.

Then, a complicated process such as rinsing with hot water after curing and soaping is required to prevent the deterioration of whiteness and to reduce the unfavorable amine order when the fabrics are finished with 1,3-dimethylglyoxalmonourein.

SUMMARY OF THE INVENTION

As the result of extensive studies to solve the above problems associated with the finishing agent comprising 1,3-dimethylglyoxalmonourein, it has been found that the use of trimethylolpropane together with 1,3-dimethylglyoxalmonourein in the finishing agent prevents the deterioration of whiteness of the fabrics and greatly reduces the unfavorable amine odor generated from finished fabrics.

Accordingly, the present invention provides a process for resin finishing fabrics which comprises treating the fabrics with a combination of 1,3-dimethylglyoxalmonourein with trimethylolpropane.

DETAILED DESCRIPTION OF THE INVENTION

The fabrics to be treated by the process of the present invention are cellulosic fabrics and blended yarn fabrics comprising the cellulosic yarns.

In the process of the present invention, commercially available trimethylolpropane and 1,3-dimethylglyoxalmonourein can be used.

Trimethylolpropane is used in an amount of from 15 to 50% by weight, preferably from 20 to 30% by weight on the basis of the weight of 1,3-dimethylglyoxalmonourein in the finishing agent. When the amount of trimethylolpropane is less than 15% by weight, the unfavorable amine odor cannot be reduced sufficiently, and when said amount is larger than 50% by weight, the deterioration of whiteness cannot be prevented sufficiently, crease resistance is lowered, a shrinking ratio increases, and hand of the fabrics becomes worse.

Generally, a mixture of 1,3-dimethylglyoxalmonourein and trimethylolpropane are used in the form of an aqueous solution. The concentration of 1,3-dimethylglyoxalmonourein in the solution is usually from 10 to 50% by weight, preferably from 20 to 40% by weight.

Trimethylolpropane is mixed with the 1,3-dimethylglyoxalmonourein solution to prepare a treating solution beforehand or just before the finishing of the fabrics. The fabrics to be finished are immersed in the treating solution, squeezed uniformly with rolls, dried and then cured so as to crosslink 1,3-dimethylglyoxalmonourein with the cellulose fibers sufficiently.

The treating agent to be used in the process of the present invention may contain a conventional catalyst for crosslinking such as magnesium chloride, zinc chloride, zinc nitrate, magnesium borofluoride. Further, the treating agent may contain various additives such as fluorescent whiting agents, natural or synthetic sizing agents, synthetic resin hand modifiers, softening agents and the like, as long as the effects of the present invention are maintained.

The process of the present invention achieves drastic reduction of the unfavorable amine odor which is generated from the fabrics finished with the conventional treating solution which contains 1,3-dimethylglyoxalmonourein but no trimethylolpropane, while the process of the present invention does not deteriorate the crease resistance and shrink-proofing of the fabrics. The present invention also prevents the deterioration of whiteness of the fabrics.

The present invention will be illustrated more in detail with reference to the following Examples, which do not limit the present invention. In Examples, "%" is by weight unless otherwise indicated.

Properties of finished fabrics in Examples were measured according to the following methods.

(1) Crease resistance: JIS L 1096B (Monsanto method)
(2) Shrinking ratio: JIS L 0217 103
(3) Tear strength: JIS L 1096D (Pendulum method)
(4) Whiteness: A -b (minus b) value is measured with a Hunter type color difference meter (manufactured by Toyo Rika Co., Ltd.)
(5) Odor:
Samples, i.e. pieces of finished fabrics, are sealed up in polyethylene bags. After keeping them standing for 24 hours, the odor in the bag is smelt.
The level of the order is evaluated according to the following criteria:
O: Substantially no odor.
Δ: Slight odor.
X: Conspicuous odor.

EXAMPLES 1-7 AND COMPARATIVE EXAMPLES 1 and 2

A cotton broad cloth (No. 40) was scoured and bleached. Then, the cotton cloth was dyed with an aqueous solution of 0.4% Whitex (a trade mark) BRF (a fluorescence dyestuff manufactured by Sumitomo Chemical Company, Limited).

The cloth was then immersed in the treating solution having the composition described in Table, squeezed to 65% in pick up with a mangle uniformly, dried at 80° C. for 2 minutes, and then cured at 150° C. for 3 minutes.

The properties (crease resistance, shrink-proofing, tensile strength, whiteness and odor) of the finished cloth were measured. The results are shown in Table.

TABLE

| | | Comparative Example | | Example | | | | | | | |
|---|---|---|---|---|---|---|---|---|---|---|---|
| Example No. | | 1 | 2 | 1 | 2 | 3 | 4 | 5 | 6 | 7 | Blank |
| Composition of treating solution | (A) 1.3-Dimethylglyoxalmonourein (as solid) (%) | 6 | 5.45 | 6 | 6 | 5.22 | 5.0 | 4.80 | 4.62 | 4.44 | — |
| | Sumitex Accelerator X-60* (%) | 4.5 | 4.5 | 4.5 | 4.5 | 4.5 | 4.5 | 4.5 | 4.5 | 4.5 | — |
| | (B) Trimethylolpropane (%) | — | 0.35 | 1.2 | 1.5 | 0.78 | 1.0 | 1.20 | 1.38 | 1.56 | — |
| | Water (%) | 89.5 | 89.5 | 88.3 | 88.0 | 89.5 | 89.5 | 89.5 | 89.5 | 89.5 | — |
| (B)/(A) × 100 (%) | | — | 10 | 20 | 15 | 15 | 20 | 25 | 30 | 35 | — |
| Crease resistance (W + F) (°) | | 233 | 235 | 237 | 238 | 235 | 233 | 233 | 230 | 228 | 191 |
| Shrinking ratio (W + F) (%) | | 3.0 | 2.9 | 2.7 | 2.7 | 3.0 | 3.0 | 3.0 | 3.1 | 3.3 | 6.7 |
| Tear strength (W + F) (g) | | 1075 | 1100 | 1125 | 1135 | 1125 | 1130 | 1135 | 1155 | 1175 | 1250 |
| Whiteness (−b value) | | 11.0 | 11.5 | 12.3 | 12.5 | 11.8 | 12.0 | 12.3 | 12.7 | 13.0 | 13.7 |
| Odor | | X | X | O | O | Δ–O | O | O | O | O | O |

Note:
*X-60: A metal salt type catalyst (manufactured by Sumitomo Chemical Company, Limited)

What we claim is:

1. A process for resin finishing cellulosic fabrics which comprises treating the fabrics with a combination of 1,3-dimethylglyoxalmonourein and trimethylolpropane.

2. The process according to claim 1, wherein the amount of trimethylolpropane is from 15 to 50% by weight on the basis of the weight of 1,3-dimethylglyoxalmonourein.

3. The process according to claim 1, wherein the combination of 1,3-dimethylglyoxalmonourein and trimethylolpropane is used in the form of an aqueous solution.

4. A process for resin finishing cellulosic fabrics which comprises immersing the fabrics in a solution of 1,3-dimethylglyoxalmonourein and trimethylolpropane, squeezing the immersed fabric, drying and then curing the fabrics.

5. The process according to claims 1 or 4 wherein said cellulosic fabrics are blended yarn fabrics comprising cellulosic yarns.

6. The process according to claim 2, wherein the combination of 1,3-dimethylglyoxalmonourein and trimethylolpropane is used in the form of an aqueous solution.

7. The process according to claim 4, wherein the amount of trimethylolpropane is from 15 to 50% by weight on the basis of the weight of 1,3-dimethylglyoxalmonourein.

8. The process according to claim 4, wherein the combination of 1,3-dimethylglyoxalmonourein and trimethylolpropane is used in the form of an aqueous solution.

9. The process according to claim 1, wherein the amount of trimethylolpropane is from 20 to 30% by weight of the basis of the weight of 1,3-dimethylglyoxalmonourein.

10. The process according to claim 3, wherein the concentration of 1,3-dimethylglyoxalmonourein in the solution is 10 to 50% by weight.

11. The process according to claim 6, wherein the concentration of 1,3-dimethylglyoxalmonourein in the solution is 10 to 50% by weight.

12. The process according to claim 3, wherein the concentration of 1,3-dimethylglyoxalmonourein in the solution is 20 to 40% by weight.

13. The process according to claim 6, wherein the concentration of 1,3-dimethylglyoxalmonourein in the solution is 20 to 40% by weight.

* * * * *